United States Patent [19]

Frantti et al.

[11] 3,944,807

[45] Mar. 16, 1976

[54] INFRARED LAMP HOLDER

[75] Inventors: Edsel W. Frantti, Pittsburgh; Ronald F. Antol, North Huntingdon, both of Pa.

[73] Assignee: White-Westinghouse Corporation, Cleveland, Ohio

[22] Filed: Jan. 20, 1975

[21] Appl. No.: 542,314

[52] U.S. Cl. ..... 240/11.2 R; 219/343; 240/47; 240/51.11 R

[51] Int. Cl.[2] ..... F21L 7/00

[58] Field of Search ..... 240/41 R, 51.11 R, 52 R, 240/11.2 R, 47; 219/343; 339/54

[56] References Cited

UNITED STATES PATENTS

| | | | |
|---|---|---|---|
| 2,988,634 | 6/1961 | Miskella | 240/47 X |
| 3,143,629 | 8/1964 | Appel et al. | 240/51.11 R |
| 3,188,459 | 6/1965 | Bridwell | 219/343 X |
| 3,751,657 | 8/1973 | Sangiamo | 240/47 X |
| 3,765,828 | 10/1973 | Lux | 240/47 X |
| 3,832,540 | 8/1974 | Roth | 240/51.11 R |

FOREIGN PATENTS OR APPLICATIONS

| | | | |
|---|---|---|---|
| 766,615 | 9/1967 | Canada | 240/47 |
| 1,060,533 | 3/1967 | United Kingdom | 240/47 |

*Primary Examiner*—R. L. Moses
*Attorney, Agent, or Firm*—McNenny, Farrington, Pearne & Gordon

[57] ABSTRACT

A tubular infrared lamp is mounted within the confines of a reflector and includes flattened, jacketed terminal structure on each end of the tube. Each terminal end extends through appropriately sized apertures in the opposed end walls of the reflector with the apertures including notches for receipt of the flattened terminals. Insulated terminal posts are mounted on the exterior side of the reflector end walls and wire leads extend tightly between the lamp ends and the corresponding post to secure the lamp against excessive axial movement. An insulating shield having an aperture, including notches, of similar size and configuration as the aperture of the end walls is disposed against the external surface of the end wall. The shield is oriented so that the notches of each respective aperture are in non-alignment, thus blocking cooling air flow, passing over the lamp ends, from entering the reflector. Also, the lamp's terminal ends are electrically shielded from the metal end wall of the reflector by the insulating shield. The shield is maintained in this angular orientation by a spring clip extending outwardly from the insulated terminal post to a position positively engaging the shield.

5 Claims, 2 Drawing Figures

INFRARED LAMP HOLDER

BACKGROUND OF THE INVENTION

1. Field of the Invention

This invention relates generally to tubular lamp mounting means and more particularly to means for mounting an infrared lamp within the confines of a reflector assembly particularly suited for an infrared oven.

2. Description of the Prior Art

Infrared tubular lamps having flattened terminal ends are well known and commercially used for space heaters and for cooking units. (See U.S. Pat. No. 3,355,574) The lamps generally extend through opposite ends of an associated reflector assembly to be clamped within insulated terminal blocks. However, in that it is necessary to maintain the terminal ends of the lamp below a temperature of approximately 350°F to provide a generally long life, and as the filament within the lamp is heated to approximately 2700°K, the prior art terminal blocks, in that they surrounded the terminal ends, generally resulted in the ends of the lamps becoming excessively heated. Further, the blocks were quite bulky, in addition to being rather expensive.

SUMMARY OF THE PRESENT INVENTION

The present invention provides a lamp mounting means for maintaining the infrared lamp in proper orientation within a reflector assembly and preventing it from excessive axial movement, yet exposing the terminal ends of the lamp to air flow for cooling. The end walls of the reflector assembly have opposing apertures sized so as to receive therethrough the tubular lamps and are notched for receipt of the flattened, jacketed end. An insulating shield having an aperture of similar size and shape is disposed adjacent the external surface of the end wall of the reflector and is rotated so as to misalign the notches of the respective apertures to generally block the apertures and notches against air flow therethrough. A lead wire extends between the lamp end and an insulated terminal post extending from the end wall. The lead wire is generally taut and therefore prevents excessive axial movement of the lamp within the apertures while allowing limited movement for shock absorbing during shipping. Also, the insulated terminal post mounts a clip extending toward the shield to engage the shield and maintain it in the rotated position. The insulator shield also provides electrical insulation between the jacketed terminal ends of the lamp and the metal end walls of the reflector.

DESCRIPTION OF THE PREFERRED EMBODIMENT

The lamp mounting means of the present invention is, in the preferred embodiment, used in an infrared oven as described in copending applications identified by the common assignee as Case Nos. 45,207 and 45,210.

Figure 1:
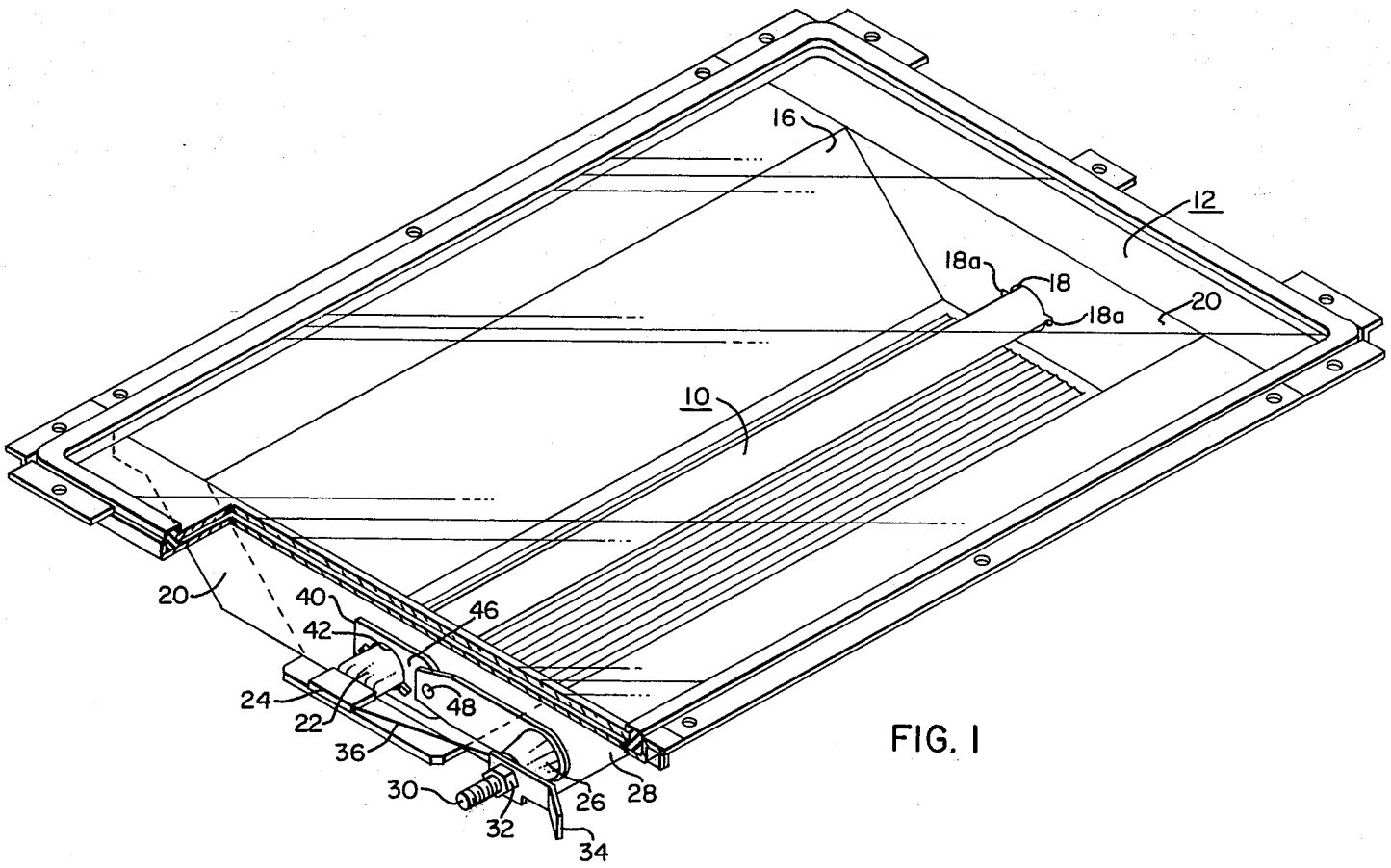
FIG. 1 is an isometric view of the reflector having the lamp mounting means of the present invention; and, FIG. 2 is a side elevational view of the end wall of the reflector with the lamp mounting means of the present invention.

Referring now to FIG. 1, the infrared lamp 10 is shown disposed within the confines of a generally concave reflector assembly 12 including a generally planar base and opposed upwardly, outwardly diverging side walls 16. The lamp 10 is properly positioned with respect to the walls by being received in apertures 18 in opposed end walls 20 of the reflector assembly.

The lamp 10, as is well known, includes a tubular envelope 22 having flattened ends enclosed in a metal terminal jacket 24 of greater width than the outer diameter of the envelope. Thus, the apertures 18 in the end walls are sized so as to generally tightly engage the envelope (allowing for sufficient manufacturing tolerances) and include diametrically opposed notches **18*a* that permit passing therethrough of the end jackets 24 on the lamp. In this orientation, the lamp 10 extends across the width of the reflector assembly 12, and in parallelism therewith, and the terminal metal ends 24 of the lamp are disposed on the outside of the end walls 20**. It is to be understood that in this preferred environment, the reflector assembly is fabricated from aluminum and the outer surface of the reflector is preferably cooled by forced air passing thereover.

Figure 2:
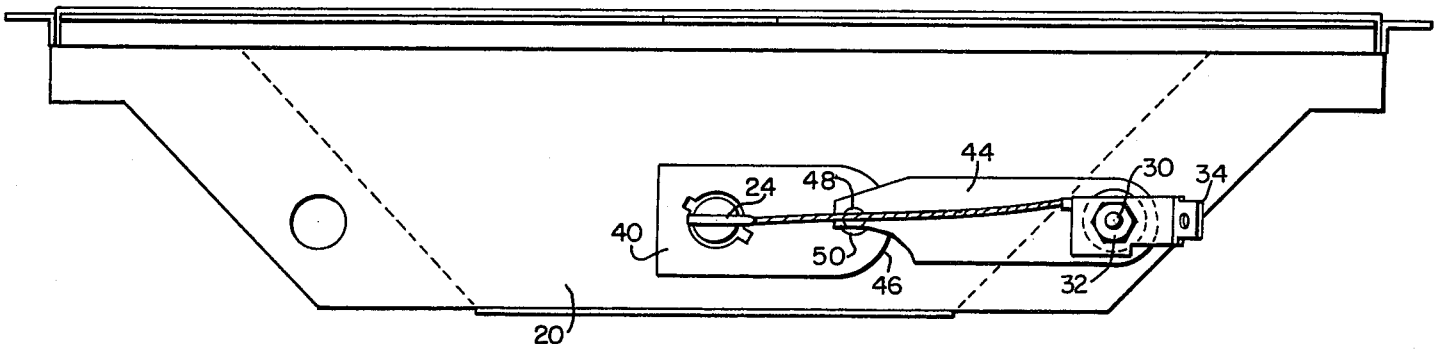

Referring now to FIG. 2 in conjunction with FIG. 1, the specific structure of maintaining the lamp 10 in the above position against axial displacement and insulatingly shielding the metal ends of the lamp from the end walls of the reflector is seen to include an insulated terminal post 26 mounted on an external extension 28 of the end wall 20. The post 26 includes complementary male **26*a* and female 26*b* portions held in assembled relationship by an axially extending threaded bolt 30 and nut 32. The post 26 is secured to the extension 28 by receipt of the male portion 26*a* within an aperture in the extension prior to receipt within the complementary female portion to capture the extension between the resulting facing engagement. A terminal connector tab 34 is also disposed on the post 26** adjacent the end of the bolt for engagement with control wiring (not shown).

An electrical lead wire 36 extends tautly between the jacketed end 24 of the lamp 20 and the end of the post 26 adjacent the connector tab and is secured to the post by an "eye connector soldered to the wire and inserted over the bolt. As such lead wire 36 is connected similarly on both ends of the lamp 10, the taut wires prevent excessive axial movement of the lamp yet permit limited axial movement beneficial as a shock absorbing mechanism when the lamp is subjected to shocks as during shipping.

Thus, it is seen that the lamp is electrically connected and held in place against excessive axial movement, yet the jacketed ends are maintained exposed to be cooled by the forced air moving across the reflector ends.

Further, for reasons of safety and also to substantially block the notches **18*a* in the aperture of the end walls, into which the forced air could otherwise flow and carry with it air borne contaminates that would reduce the reflectivity of the interior of the reflector assembly, an insulating shield 40 is disposed in facing engagement with the exterior of each end wall. The insulating shield 40 comprises a sheet of bonded mica and includes therein an aperture 42 having similar size and shape as apertures 18 in the end walls so that it generally engages the envelope yet has notches 42 a to permit passage of the flattened ends of the lamp. The shield 40 is maintained in proper position against the external surface of the end wall and with the notches 42*a* sufficiently out of alignment with the notches 18***a* in the end wall so that each is blocked by structure of the other, by a spring clip member 44. The clip member 44 comprises a strip of metal having an aperture in one end (not shown) and held in position by being captured between the male 26*a* and female 26*b* parts of the insulated terminal post 26 in the same manner the extension 28 is captured therebetween for mounting the post. The clip 44 extends therefrom a sufficient distance to overlie a projection 46 of the insulating shield 40. Preferably, the clip, in this portion, includes an inwardly projecting dimple 48 that coincides with an indexing aperture 50 in the shield 40 to positively prevent the shield from rotating under normal circumstances and maintains it in the above-described orientation.

Thus, the notches, 18*a* and 42*a*, for the most part, are blocked to prevent air flow therethrough and the metal ends 24 of the lamp are positively prevented from contacting the metal end walls 20 if for some reason (i.e., broken or too much slack in the lead wires) sufficient axial movement of the lamp 10 is permitted which otherwise would have made this contact. To this end, it is noted that the notches 42*a* and the insulating shield 40 are also maintained out of alignment with the complimentary flat structure of the jacketed ends 26 of the lamp 10.

Thus, through the lamp holding structure of the present invention, the lamp 10 is prevented from displacement by being received in opposed apertures in the end walls of the reflector assembly and secured therein by taut lead wires extending from the lamp to an adjacent insulated post, thereby exposing the lamp ends to cooling air while at the same time providing shock absorbing characteristics. The end walls 20 of the reflector assembly are also shielded from arcing across the gap between the end walls and the terminal jacket 24, or by actual contact therebetween, by an insulating shield 40 that is held in its proper orientation by an adjacent clip. This shield also blocks the notches 18*a* of the aperture 18 in the side wall to prevent ingress of air therethrough to the reflector cavity that might otherwise contaminate the reflector surfaces and alter their reflective capabilities.

What we claim is:

1. Structure for securing a tubular shaped lamp having broad flattened terminal ends within a reflector assembly including opposed end walls defining apertures generally conforming to the tubular portion of the lamp and including notches for receipt therethrough of said terminal ends, said terminal ends being spaced from said end walls in said secured position, said structure comprising:

a post member mounted on said assembly generally adjacent each terminal end of said lamp;

a lead wire attached to said terminal end and connected to said post member, said wire being generally taut between said lamp and said post to prevent excessive axial movement of said lamp and also maintain said terminal ends in a predetermined angular orientation with respect to said notches in said aperture;

a sheet of insulating material interposed between said terminal end and said end wall, said sheet defining an aperture including notches generally coextensive with the aperture in said end wall; and, means for retaining said sheet in said position against said end wall and with the notches in the aperture therein at an angular orientation distinct from the angular orientation of the associated terminal end of said lamp whereby the terminal end and end wall are electrically shielded from each other by said sheet.

2. Structure according to claim 1 wherein said notches in the aperture in said insulating sheet are also maintained at an angular orientation distinct from the notches in said side wall whereby structure of each said side wall or said sheet blocks the notches of the other to generally prevent air flow through said respective notches.

3. Structure according to claim 2 wherein said post member is an insulated terminal post.

4. Structure according to claim 2 wherein said means for retaining said insulating sheet comprises a clip member mounted at one end to said assembly and having a generally free end extending to overlie said sheet, said free end of said clip being resiliently biased towards said end wall.

5. Structure according to claim 4 wherein said free end of said clip member includes an inwardly shock dimple extending toward said end wall and said sheet includes an indexing aperture for receipt of said dimple to maintain said sheet in the proper angular orientation.

* * * * *